US005722116A

United States Patent [19]

Lin

[11] Patent Number: 5,722,116

[45] Date of Patent: Mar. 3, 1998

[54] TOOL HANDGRIP HAVING A SIMPLIFIED LONGITUDINAL SOFTER ZONES

[76] Inventor: Jack Lin, No. 103, Nan Kang San Road, Nan Kang Industrial Zone, Nan Tou City, Nan Tou County, Taiwan

[21] Appl. No.: 625,166

[22] Filed: Apr. 1, 1996

[51] Int. Cl.[6] ..... A47B 95/02; B25G 1/10

[52] U.S. Cl. ..... 16/110 R; 16/111 R; 16/DIG. 12; 16/DIG. 19; 81/177.1

[58] Field of Search ..... 16/110 R, 111 R, 16/DIG. 12, DIG. 18, DIG. 19; 81/177.1, 489, 490, 492

[56] References Cited

U.S. PATENT DOCUMENTS

| | | | |
|---|---|---|---|
| 2,871,899 | 2/1959 | Coyle | 81/177.1 |
| 2,985,209 | 5/1961 | Novelo | 81/177.1 |
| 4,729,271 | 3/1988 | Kenigson | 16/111 R |
| 4,739,536 | 4/1988 | Bandera et al. | 16/111 R |
| 5,145,082 | 9/1992 | Craft, Jr. et al. | 16/111 R |
| 5,390,572 | 2/1995 | Gakhar et al. | 16/111 R |
| 5,398,369 | 3/1995 | Heinzelman et al. | 16/111 R |
| 5,530,989 | 7/1996 | Remmert et al. | 16/110 R |
| 5,551,323 | 9/1996 | Beere et al. | 16/111 R |
| 5,601,003 | 2/1997 | Amtenbrink et al. | 81/177.1 |

FOREIGN PATENT DOCUMENTS

| | | | |
|---|---|---|---|
| 2635998 | 3/1990 | France | 81/489 |

*Primary Examiner*—Chuck Mah
*Assistant Examiner*—Donald M. Gurley
*Attorney, Agent, or Firm*—Charles E. Baxley, Esq.

[57] ABSTRACT

A tool handgrip includes a core having two or more spaced longitudinal ridges secured to the outer peripheral portion of the core. The longitudinal ridges each includes a thickness ranging from 1 mm to 6 mm and each includes a hardness less than that of the core. The hardness of the longitudinal ridges ranges from SHORE A 35 to 75. The longitudinal ridges each includes one or more projections extended inward of the core or each includes a step ladder shaped surface for engaging with a corresponding step ladder shaped surface of the core for solidly securing the longitudinal ridges to the core.

1 Claim, 5 Drawing Sheets

TOOL HANDGRIP HAVING A SIMPLIFIED LONGITUDINAL SOFTER ZONES

BACKGROUND OF THE INVENTION

1. Field of the Invention

The present invention relates to a tool handgrip, and more particularly to a tool handgrip having a simplified longitudinal softer zones.

2. Description of the Prior Art

A typical tool handgrip is disclosed in U.S. Pat. No. 4,739,536 to Bandera et al., issued on Apr. 26, 1988. The typical tool handgrip comprises a harder zone and a number of softer zones. However, a number of channels or recesses are required to be formed in the handgrip for engaging with softer ring zone and elastic shells. The configuration of the tool handgrip is adverse for manufacturing purposes such that the tool handgrip may not be easily manufactured and such that the manufacturing cost thereof is greatly increased.

The present invention has arisen to mitigate and/or obviate the afore-described disadvantages of the conventional tool handgrips.

SUMMARY OF THE INVENTION

The primary objective of the present invention is to provide a tool handgrip including a greatly simplified configuration that is excellent for manufacturing purposes and for facilitating the gripping thereof.

In accordance with one aspect of the invention, there is provided a tool handgrip comprising a handgrip body including a core having an outer peripheral portion, and at least two longitudinal ridges secured to the outer peripheral portion of the core, the longitudinal ridges each including a thickness ranging from 1 mm to 6 mm, and the longitudinal ridges including a hardness less than that of the core, the hardness of the longitudinal ridges ranging from SHORE A 35 to 75.

The longitudinal ridges each includes at least one projection extended inward of the core for solidly securing the longitudinal ridges to the core.

The longitudinal ridges each includes a ladder shaped surface for engaging with a corresponding ladder shaped surface of the core.

The longitudinal ridges each includes an arcuate shape for engaging with a corresponding arcuate shape of the core.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
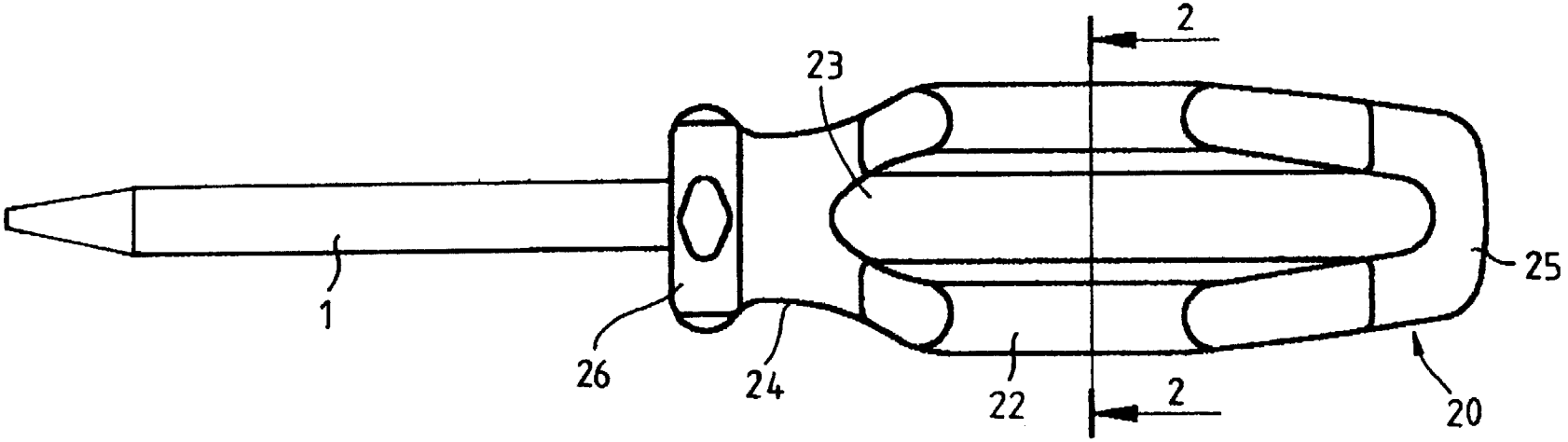
FIG. 1 is a front view of a tool handgrip in accordance with the present invention.
Figure 2:
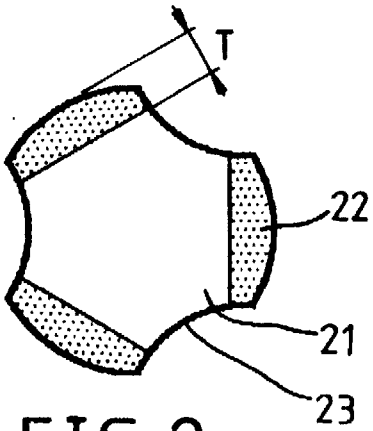
FIG. 2 is a cross sectional view taken along lines 2—2 of FIG. 1.

Referring to FIGS. 1 and 2, a tool handgrip in accordance with the present invention comprises a handgrip body 20 for engaging with a screw driver bit 1 or other tool bits so as to operate or drive the tool bits. The tool bits 1 are not related to the present invention and will not be described in further details. The handgrip body 20 includes a care 21 and three spaced longitudinal ridges 22 secured on the outer peripheral portion of the core 21 so as to define three recesses 23 therebetween for facilitating the gripping of the tool handgrip. The ridges 22 each includes a thickness T ranging from 1 mm to 6 mm. The core 21 includes a hardness ranging from SHORE D 65–75. The ridges 22 are softer than the core 21 and include a hardness ranging from SHORE A 35 to 75.

It is to be noted that the core 21 and the three spaced longitudinal ridges 22 may be extruded and formed by an extruder machine easily and fastly. The core 21 and the longitudinal ridges 22 are secured together and solidified together during the extruding operations. The extruding processes are not related to the present invention and will not be described in further details. However, the configuration of the tool handgrip is designed to be easily and quickly manufactured by the processes described above. The front portion of the handgrip body 20 is machined to form a circular head 26 and a circular depression or a neck portion 24. The rear portion of the handgrip body 20 is machined to form a tail portion 25. Accordingly, the tool handgrips can be easily and quickly manufactured.

Figure 3:
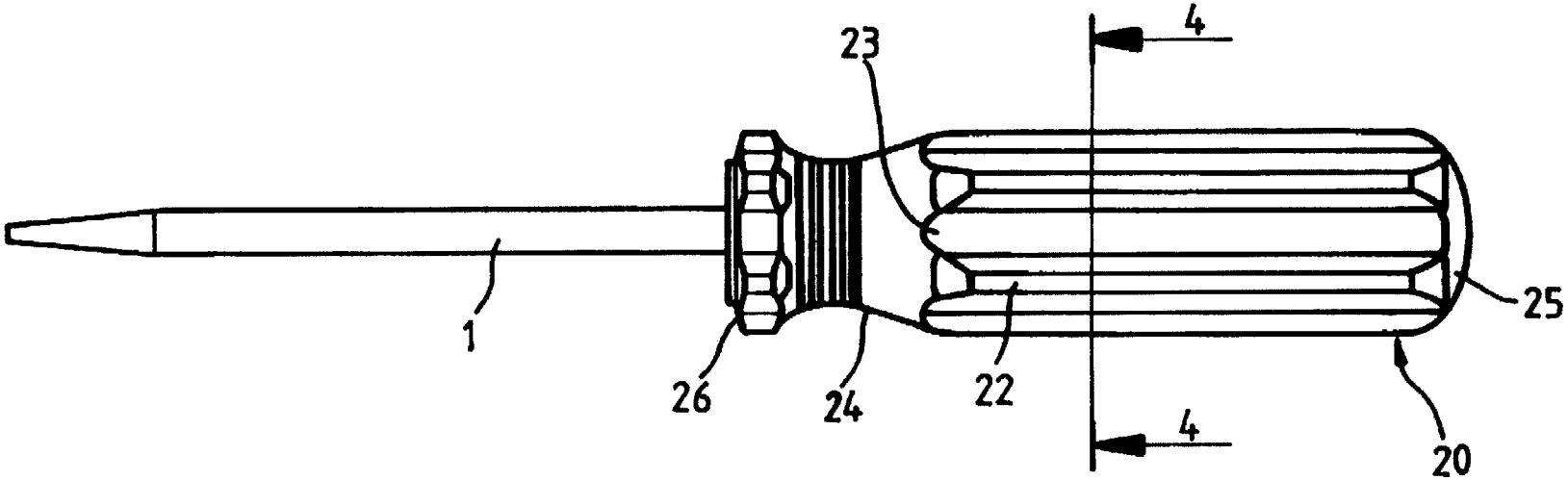
FIGS. 3, 5, 7 are front views illustrating three applications of the tool handgrip.
Figure 4:
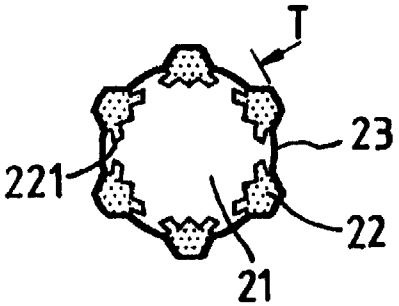
FIGS. 4, 6, 8 are cross sectional views taken along lines 4—4, 6—6, 8—8 of FIGS. 3, 5, 7 respectively.

Referring next to FIGS. 3 and 4, six ridges 22 are secured on the peripheral portion of the core 21 and each includes one or more projections 221 extended inward of the core 21 such that the ridges 22 may be solidly secured to the core 21. The projections 221 may be easily formed during the extruding processes.

Figure 5:
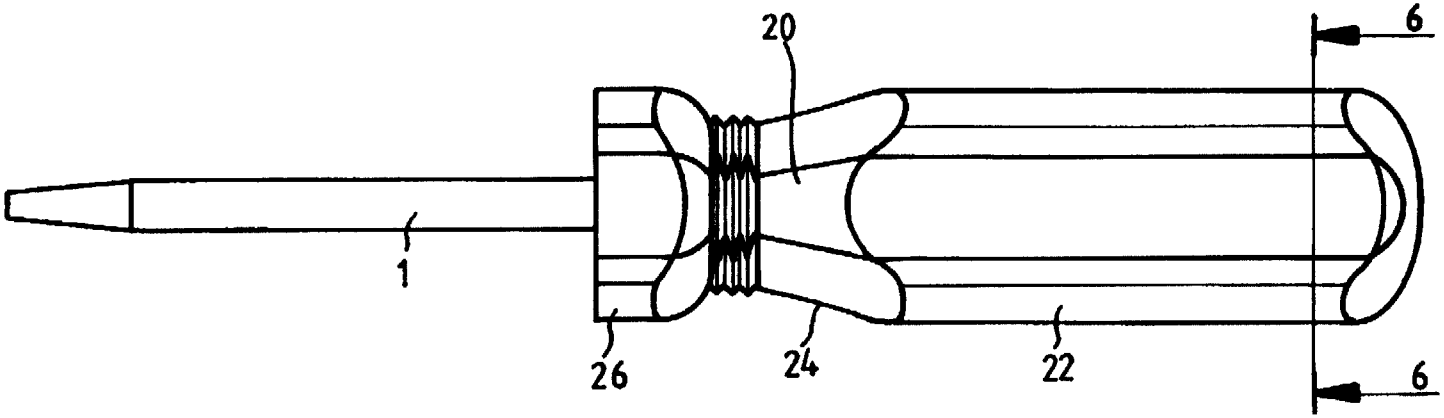
Figure 6:
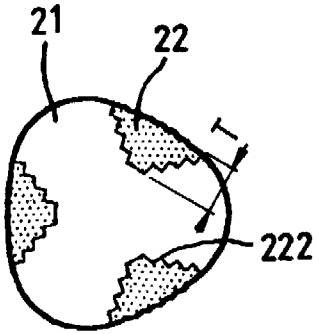

Referring next to FIGS. 5 and 6, the ridges 22 each includes a step ladder shaped connecting surface 222 for engaging with the corresponding step ladder shaped connecting surface of the core 21 such that the ridges 22 may be solidly secured to the core 21. The step ladder shaped connecting surface 222 may also be easily formed during the extruding processes.

Figure 7:
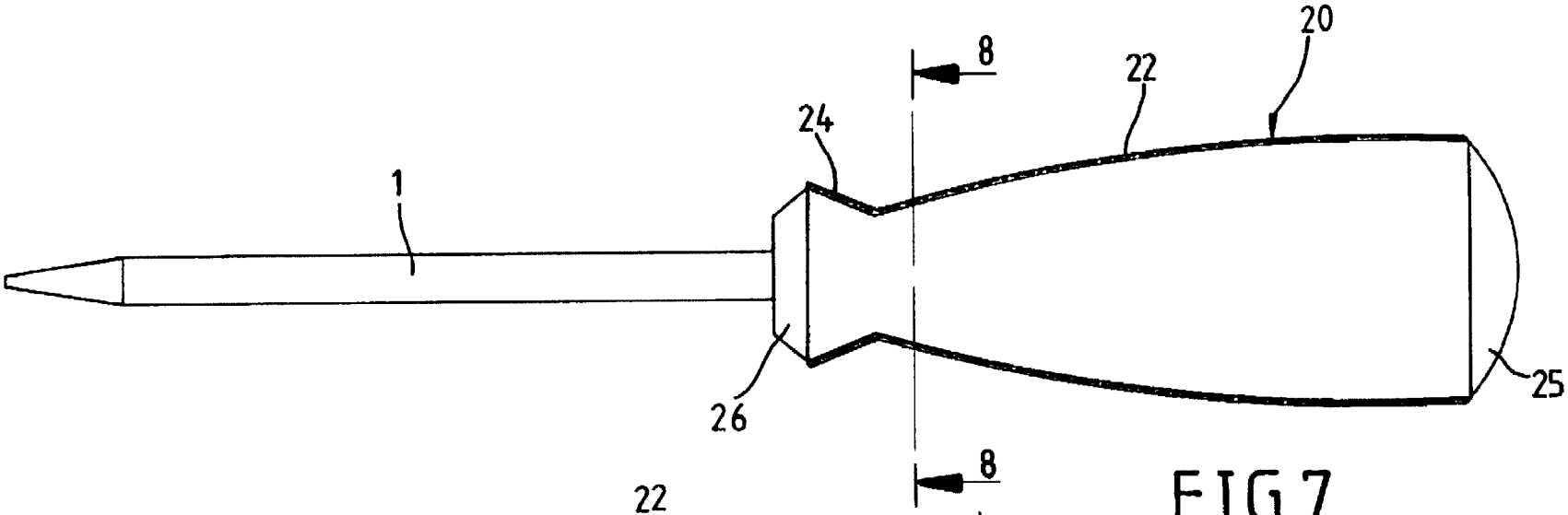
Figure 8:
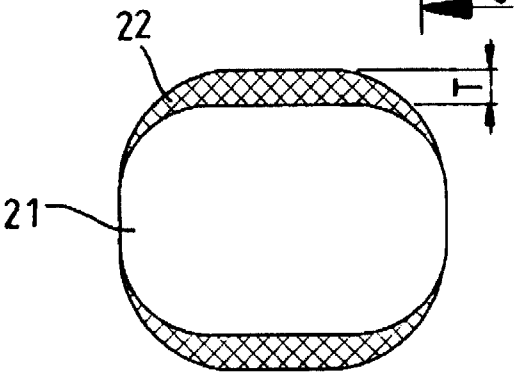

Referring next to FIGS. 7 and 8, the ridges 22 each includes an arcuate shape for engaging with the corresponding arcuate outer peripheral portion of the core 21 such that the ridges 22 may also be solidly secured to the core 21.

Figure 9:
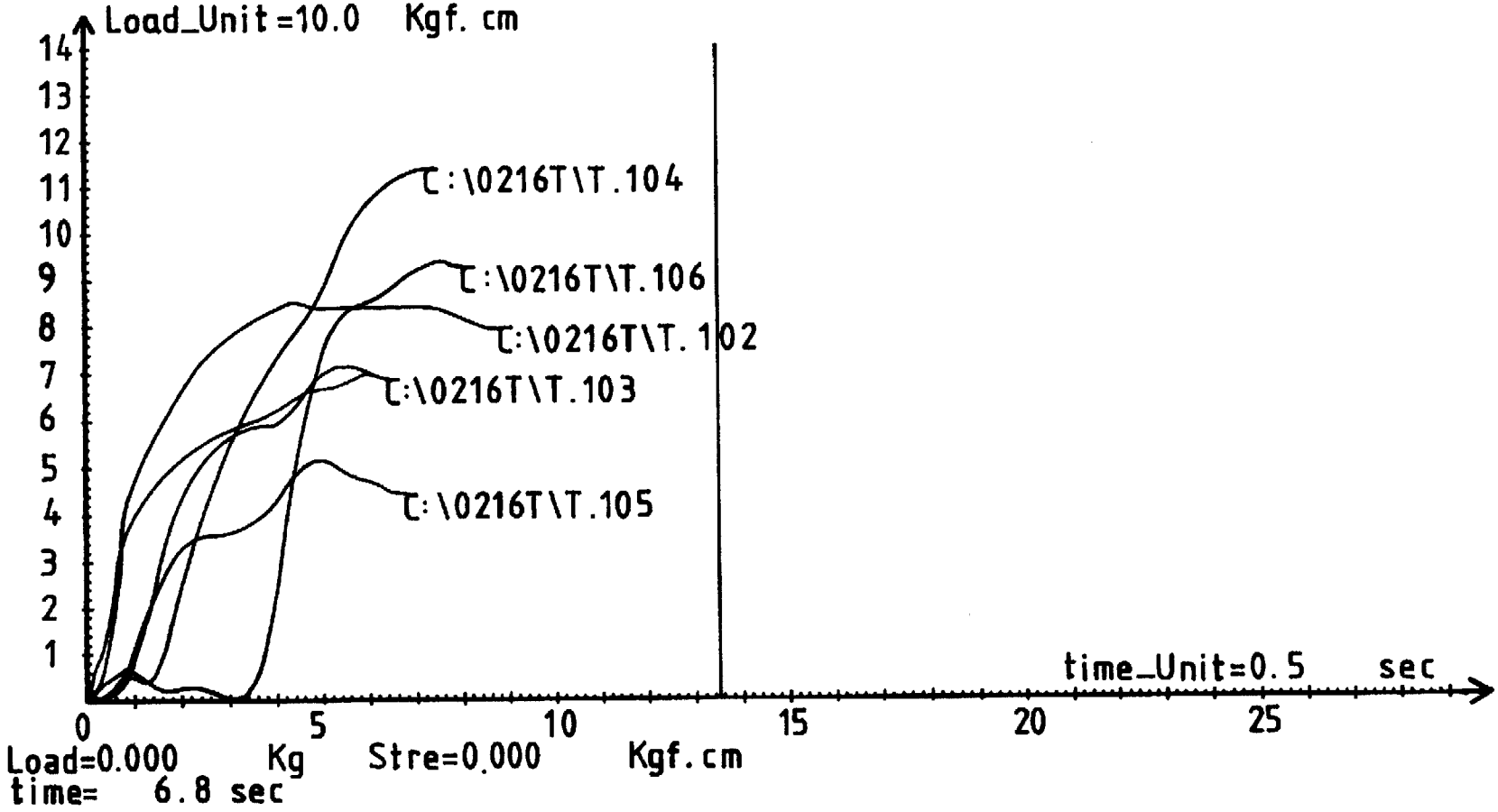
FIG. 9 is a diagram illustrating the testing values of a test to the tool handgrips.

Referring next to Table 1 and FIG. 9, a test has been conducted for testing the torques of the typical tool handgrips and the present tool handgrips. In this test, 6 samples are tested; in which T101 and T102 include an identical size, T103 and T104 include an identical size, T105 and T106 include an identical size. T101, T103, T105 are typical tool handgrips, and T102, T104, T106 are the tool handgrips of the present invention. The unit of the torque is Kgf-cm.

TABLE 1 test of torques of six samples

| sample | torque (Kgf-cm) |
|---|---|
| T101 | 69.3 |
| T102 | 84.2 |
| T103 | 71.3 |

TABLE 1-continued test of torques of six samples

| sample | torque (Kgf-cm) |
|---|---|
| T104 | 114.2 |
| T105 | 51.4 |
| T106 | 94.0 |

Accordingly, the tool handgrip in accordance with the present invention includes a greatly simplified configuration that is excellent for manufacturing purposes end for facilitating the gripping thereof.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool handgrip comprising:

a handgrip body including a core having an outer peripheral portion, said outer peripheral portion having at least two peripherally spaced longitudinally extending recesses with ridges secured therein.

said longitudinal ridges each having a thickness ranging from 1 mm to 6 mm, and said longitudinal ridges having a hardness less than that of said core, the hardness of said longitudinal ridges ranging from SHORE A 35 to 75 , and said longitudinal ridges each including a step ladder shaped surface for engaging with a corresponding step ladder shaped surface of said core and for preventing said longitudinal ridges from being disengaged from said core.

* * * * *